US009188316B2

(12) United States Patent
Daily et al.

(10) Patent No.: US 9,188,316 B2
(45) Date of Patent: Nov. 17, 2015

(54) LED SOCKET ASSEMBLY

(75) Inventors: Christopher George Daily, Harrisburg, PA (US); Matthew Edward Mostoller, Hummelstown, PA (US); Ronald Martin Weber, Annville, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 577 days.

(21) Appl. No.: 13/295,863

(22) Filed: Nov. 14, 2011

(65) Prior Publication Data

US 2013/0122729 A1 May 16, 2013

(51) Int. Cl.
*F21V 19/00* (2006.01)
*F21Y 101/02* (2006.01)

(52) U.S. Cl.
CPC ..... *F21V 19/003* (2013.01); *F21Y 2101/02* (2013.01)

(58) Field of Classification Search
CPC ... F21V 15/012; F21V 19/042; F21V 19/045; F21V 21/14; F21V 21/34; F21V 19/0015
USPC ..... 362/362, 547, 549, 548, 217.16, 217.12
See application file for complete search history.

(56) References Cited

U.S. PATENT DOCUMENTS

| | | | | |
|---|---|---|---|---|
| 4,042,290 | A * | 8/1977 | Czitrom | 439/346 |
| 6,166,916 | A | 12/2000 | Jelinger | |
| 7,549,786 | B2 * | 6/2009 | Higley et al. | 362/646 |
| 8,016,469 | B2 * | 9/2011 | Takeda et al. | 362/543 |
| 2006/0128200 | A1 | 6/2006 | McEwan et al. | |
| 2008/0094810 | A1 | 4/2008 | Lajara et al. | |
| 2011/0136374 | A1 * | 6/2011 | Mostoller et al. | 439/487 |

FOREIGN PATENT DOCUMENTS

| | | |
|---|---|---|
| EP | 0 943 860 A1 | 9/1999 |
| EP | 2 333 398 A2 | 6/2011 |

OTHER PUBLICATIONS

European Search Report, Mail Date, Dec. 3, 2013, EP 12 192 575.4, Application No. 12192575.4-1757 / 2592336.

* cited by examiner

*Primary Examiner* — Sharon Payne

(57) ABSTRACT

A socket housing is provided for light emitting diode (LED) packages having an LED printed circuit board (PCB). The socket housing includes first and second housing segments that define a recess therebetween for receiving an LED package therein. The first and second housing segments are configured to engage the LED PCB of the LED package to secure the LED package within the recess. A relative position between the first and second housing segments is selectively adjustable such that a size of the recess is selectively adjustable for receiving differently sized LED packages therein.

20 Claims, 11 Drawing Sheets

LED SOCKET ASSEMBLY

BACKGROUND OF THE INVENTION

The subject matter herein relates generally to solid state lighting assemblies, and more particularly, to LED socket assemblies.

Solid-state light lighting systems use solid state light sources, such as light emitting diodes (LEDs), and are being used to replace other lighting systems that use other types of light sources, such as incandescent or fluorescent lamps. The solid-state light sources offer advantages over the lamps, such as rapid turn-on, rapid cycling (on-off-on) times, long useful life span, low power consumption, narrow emitted light bandwidths that eliminate the need for color filters to provide desired colors, and/or so on.

LED lighting systems typically include one or more LED packages that include one or more LEDs on a printed circuit board (PCB), which is referred to herein as an "LED PCB". The LED packages 12 may be what is commonly referred to as a "chip-on-board" (COB) LED, or may be any other type of LED package, such as, but not limited to, an LED package that includes an LED PCB and one or more LEDs soldered to the LED PCB. In at least some known LED lighting systems, the LED PCB is held within a recess of a socket housing that is mounted to a support structure of the lighting fixture, for example a base, a heat sink, and/or the like. The socket housing may hold electrical contacts that engage power pads on the LED PCB to electrically connect the LED(s) to an electrical power source. But, known socket housings are not without disadvantages. For example, LED PCBs are available in a variety of sizes. The size of the LED PCB may depend on the size of the LED(s) mounted thereon, the number of LEDs mounted thereon, the shape of the LED(s) mounted thereon, and/or the like. Known socket housings only accommodate a single size of LED PCBs. In other words, the recess of a particular socket housing is sized to receive only one particular size of LED PCBs. Accordingly, a different socket housing must be fabricated for each differently sized LED PCB, which may increase the cost of LED lighting systems and/or may increase the difficulty and/or time required to fabricate LED lighting systems.

BRIEF DESCRIPTION OF THE INVENTION

In one embodiment, a socket housing is provided for light emitting diode (LED) packages having an LED printed circuit board (PCB). The socket housing includes first and second housing segments that define a recess therebetween for receiving an LED package therein. The first and second housing segments are configured to engage the LED PCB of the LED package to secure the LED package within the recess. A relative position between the first and second housing segments is selectively adjustable such that a size of the recess is selectively adjustable for receiving differently sized LED packages therein.

In another embodiment, a socket assembly includes a first light emitting diode (LED) package having a first LED printed circuit board (PCB) with an LED mounted thereto. The first LED package has a power pad configured to receive power from a power source to power the LED. The socket assembly includes a socket housing having a recess that receives the first LED package therein. The socket housing includes first and second housing segments that engage the first LED PCB to secure the first LED package within the recess. A relative position between the first and second housing segments is selectively adjustable such that a size of the recess is selectively adjustable for receiving at least one second LED package that includes a second LED PCB that is differently sized relative to the first LED PCB of the first LED package.

In another embodiment, a socket housing is provided for light emitting diode (LED) packages having an LED printed circuit board (PCB). The socket housing includes first and second housing segments that define a recess therebetween for receiving an LED package therein. The first and second housing segments are configured to engage the LED PCB of the LED package to secure the LED package within the recess. The first and second housing segments include first and second arms, respectively. The first and second arms are engaged with each other to mechanically connect the first and second housing segments together. A relative position between the first and second arms is selectively adjustable such that a size of the recess is selectively adjustable.

DETAILED DESCRIPTION OF THE INVENTION

Figure 1:
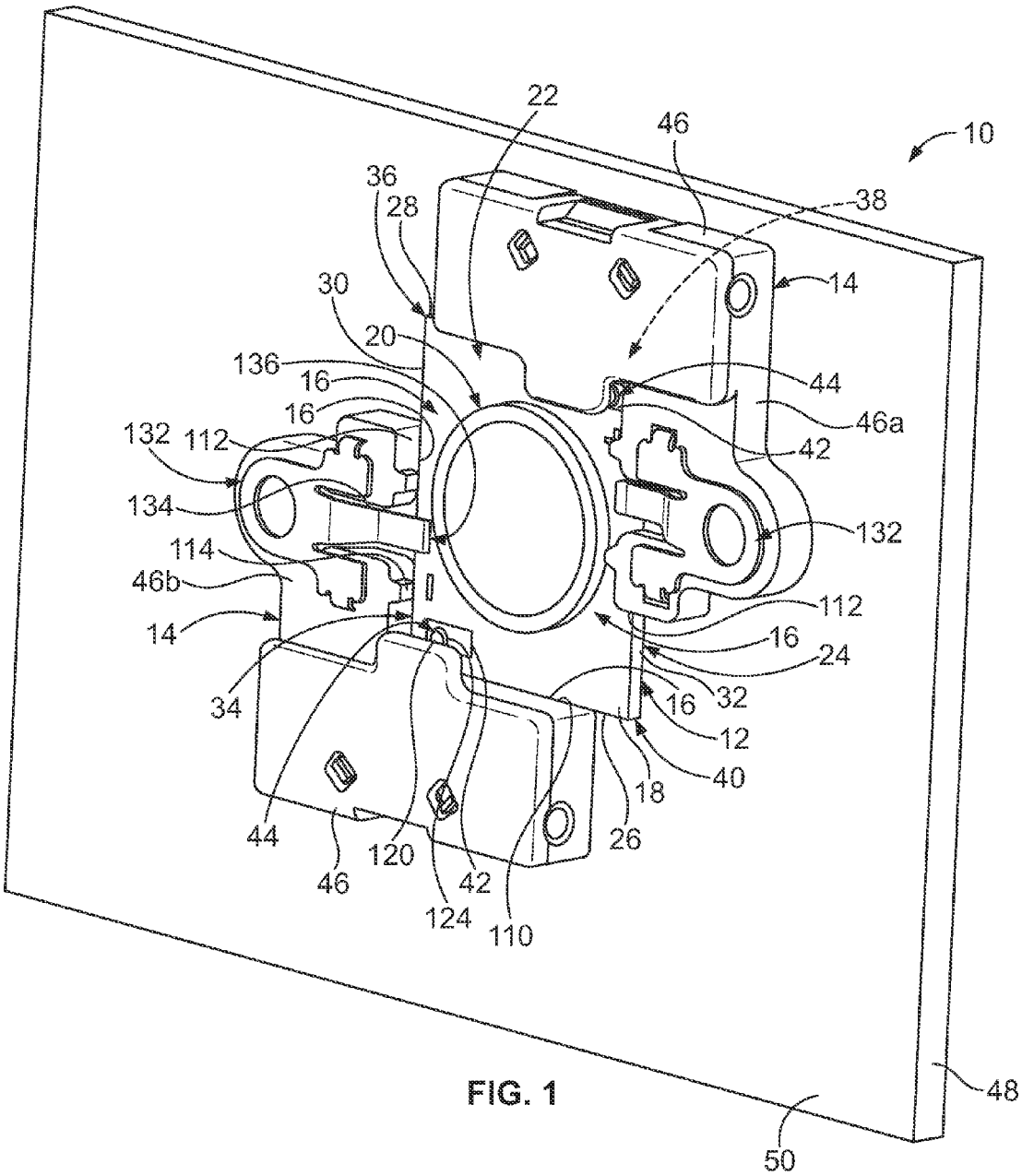
FIG. 1 is a perspective view of an exemplary embodiment of a socket assembly illustrating the socket assembly mounted to an exemplary support structure.

FIG. 1 is a perspective view of an exemplary embodiment of a socket assembly 10. The socket assembly 10 may be part of a light engine, a light fixture, or other lighting system that is used for residential, commercial or industrial use. The socket assembly 10 may be used for general purpose lighting, or alternatively, may have a customized application or end use.

The socket assembly 10 includes a light emitting diode (LED) package 12 and a socket housing 14. The socket housing 14 includes a recess 16 that receives the LED package 12 therein. The LED package 12 includes an LED printed circuit board (PCB) 18 with an LED 20 mounted thereto. In the exemplary embodiment, a single LED 20 is mounted to the LED PCB 18, however it is realized that any number of LEDs 20 may be mounted to the LED PCB 18. The LED PCB 18 may be sized appropriately depending on the number of LEDs 20 mounted thereto. The LED PCB 18 includes opposite sides 22 and 24. The LED 20 is mounted on the side 22 of the LED PCB 18. In the exemplary embodiment, the LED PCB 18 includes a rectangular shape having opposite edges 26 and 28, opposite edges 30 and 32, and four corners 34, 36, 38, and 40. But, the LED PCB 18 may additionally or alternatively include any other shape, any other number of edges, any other number of corners, and/or the like.

The LED package 12 includes a plurality of power pads 42 on the LED PCB 18. In the exemplary embodiment, the power pads 42 are positioned proximate corresponding edges 26 and 28 and adjacent corresponding corners 34 and 38 of the LED PCB 18. Alternative arrangements of the power pads 42 are possible in alternative embodiments. For example, the power pads 42 may all be positioned proximate to one of the edges 26, 28, 30, or 32, and/or the power pads 42 may all be positioned adjacent one of the corners 34, 36, 38, or 40 of the LED PCB 18. Any number of power pads 42 may be provided, including a single power pad 42. In the exemplary embodiment, the LED package 12 is what is commonly referred to as a "chip-on-board" (COB) LED. But, the LED package 12 may be any other type of LED package, such as, but not limited to, an LED package that includes an LED PCB and one or more LEDs soldered to the LED PCB.

As described above, the socket assembly 10 includes the socket housing 14, which includes the recess 16 that holds the LED package 12. The socket assembly 10 is mounted to a support structure 48. The support structure 48 may be any structure to which the socket assembly 10 is capable of being mounted to, such as, but not limited to, a base, a heat sink, and/or the like. The support structure 48 includes a surface 50 to which the socket assembly 10 is mounted. Optionally, at least a portion of the surface 50 is approximately flat. The LED package 12 optionally engages the support structure 48 when the socket assembly 10 is mounted to the support structure 48. As will be described below, the socket housing 14 holds power contacts 44 that engage the power pads 42 of the LED PCB 18 to supply the LED 20 with electrical power from a source (not shown) of electrical power.

The socket housing 14 includes two or more discrete housing segments 46. The housing segments 46 cooperate to define the recess 16 that receives the LED package 12. More specifically, the recess 16 is defined between the housing segments 46, as is illustrated in FIG. 1. Each of the housing segments 46 engages the LED PCB 18 to secure the LED package 12 within the recess 16. In the exemplary embodiment of FIGS. 1-8, the housing segments 46 of the socket housing 14 do not engage each other when an LED package 12 is held within the recess 16 of the socket housing 14. Alternatively, the housing segments 46 engage each other when the LED package 12 is held within the recess 16, for example as described below and illustrated in FIGS. 10, 11, and 14 with regard to the socket housing 314. In the exemplary embodiment, a shape of the recess 16 is defined by an L-shape of each of the housing segments 46. But, the recess 16 and each of the housing segments 46 may additionally or alternatively include any other shape(s), which may depend on the shape of at least a portion of one or more LED PCBs.

In the exemplary embodiment, the socket housing 14 includes two discrete housing segments 46*a* and 46*b* that cooperate to define the recess 16. But, the socket housing 14 may include any other number of discrete housing segments 46 that is greater than two for defining the recess 16. Optionally, the discrete housing segments 46*a* and 46*b* are substantially identical and/or hermaphroditic. For example, the discrete housing segments 46*a* and 46*b* are optionally fabricated using one or more of the same molds.

A relative position between the housing segments 46*a* and 46*b* is selectively adjustable such that a size of the recess 16 is selectively adjustable for receiving at least one other differently sized LED package (e.g., the LED packages 69-86 shown in FIG. 3) in place of the LED package 12. The socket housing 14 is thus configured to individually receive a plurality of differently sized LED packages within the recess 16.

Figure 2:
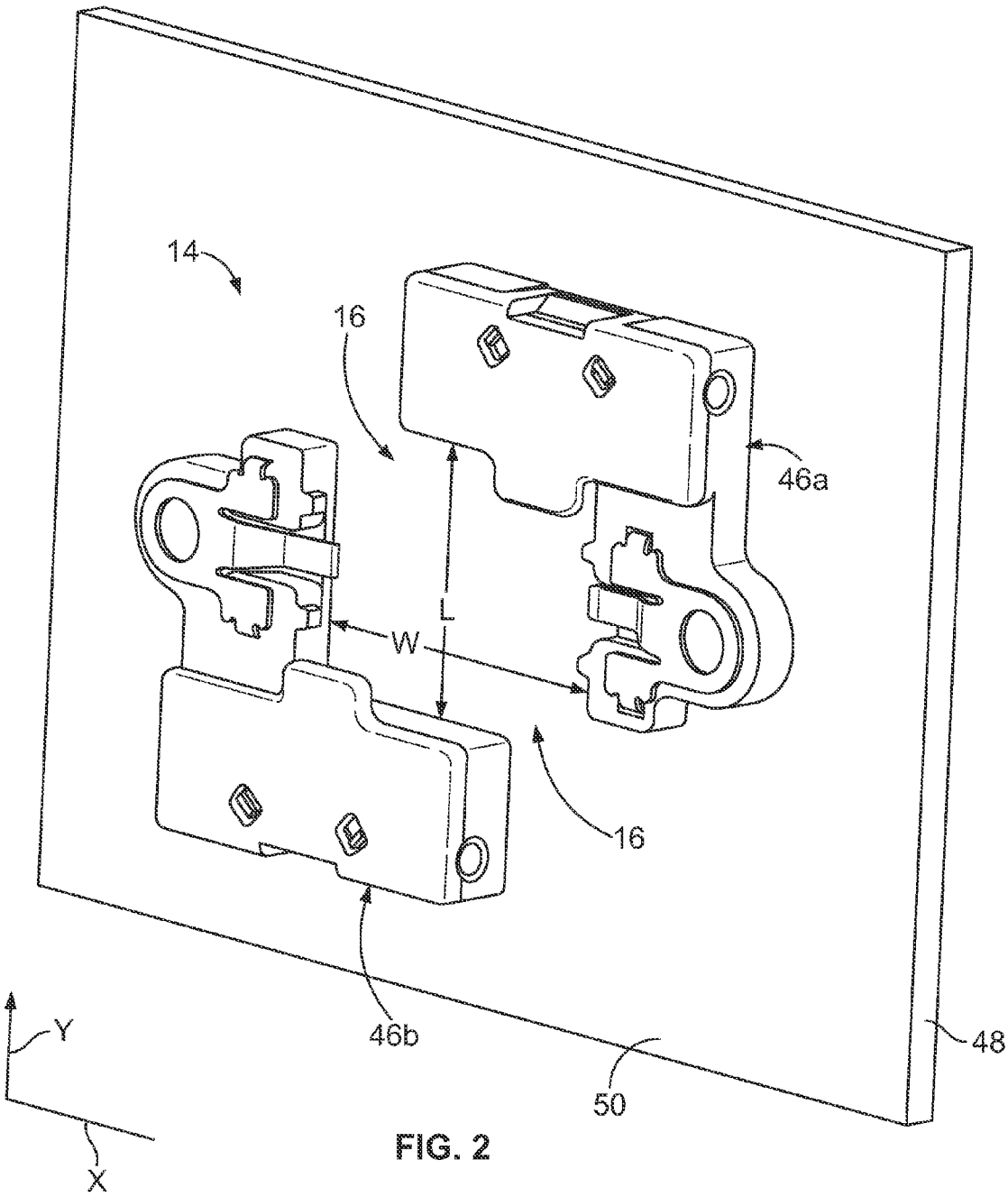
FIG. 2 is a perspective view of an exemplary embodiment of a socket housing of the socket assembly shown in FIG. 1.

FIG. 2 is a perspective view illustrating the selective adjustability of the relative position between the housing segments 46*a* and 46*b*. More specifically, FIG. 2 is a perspective view of an exemplary embodiment of the socket housing 14 resting on the exemplary support structure 48. FIG. 2 illustrates the housing segments 46*a* and 46*b* arranged to define the recess 16 therebetween.

The relative position between the housing segments 46*a* and 46*b* is selectively adjustable. For example, each housing segment 46*a* and 46*b* can be moved relative to the other housing segment 46*a* or 46*b* along an X coordinate axis and along a Y coordinate axis, as shown in FIG. 2. The relative position between the housing segments 46*a* and 46*b* along the X and Y coordinate axes defines the size of the recess 16 defined between the housing segments 46 and 46*b*. Accordingly, the size of the recess 16 is selectively adjustable. In the example shown in FIG. 2, the housing segments 46*a* and 46*b* are movable along the surface 50 of the support structure 48 relative to each other to adjust the size of the recess 16. In other words, the mounting location on the support structure 48 of each of the housing segments 46*a* and 46*b* can be changed relative to the mounting location of the other housing segment 46*a* or 46*b* to adjust the size of the recess 16.

In the example shown in FIG. 2, the recess 16 includes a shape having a length L and a width W. The length L of the recess 16 is adjustable by moving the housing segments 46*a* and 46*b* relative to each other along the Y coordinate axis. The width W of the recess 16 is adjustable by moving the housing segments 46 and 46*b* relative to each other along the X coordinate axis. Accordingly, the size of the recess 16 is adjustable by adjusting the width W of the recess 16 and/or by adjusting the length L of the recess 16.

The adjustability of the recess size enables the size of recess 16 to be selected for a particular LED package having a particular size (e.g., the particular size of an LED PCB of the particular LED package). In other words, the size of the recess 16 can be selected to configure the recess 16 to receive (e.g., be complementary with) the size of a particular LED package. For example, the length L and/or the width W of the recess 16 can be selected to be approximately the same, or slightly larger, than the length and/or the width, respectively, of a particular LED package. Accordingly, the socket housing 14 is configured to individually receive a plurality of differently sized LED packages within the recess 16 via selective adjustment of the size of the recess 16. The socket housing 14 may be configured such that an LED package can be removed from the recess 16 and replaced by a differently-sized LED package.

Figure 3:
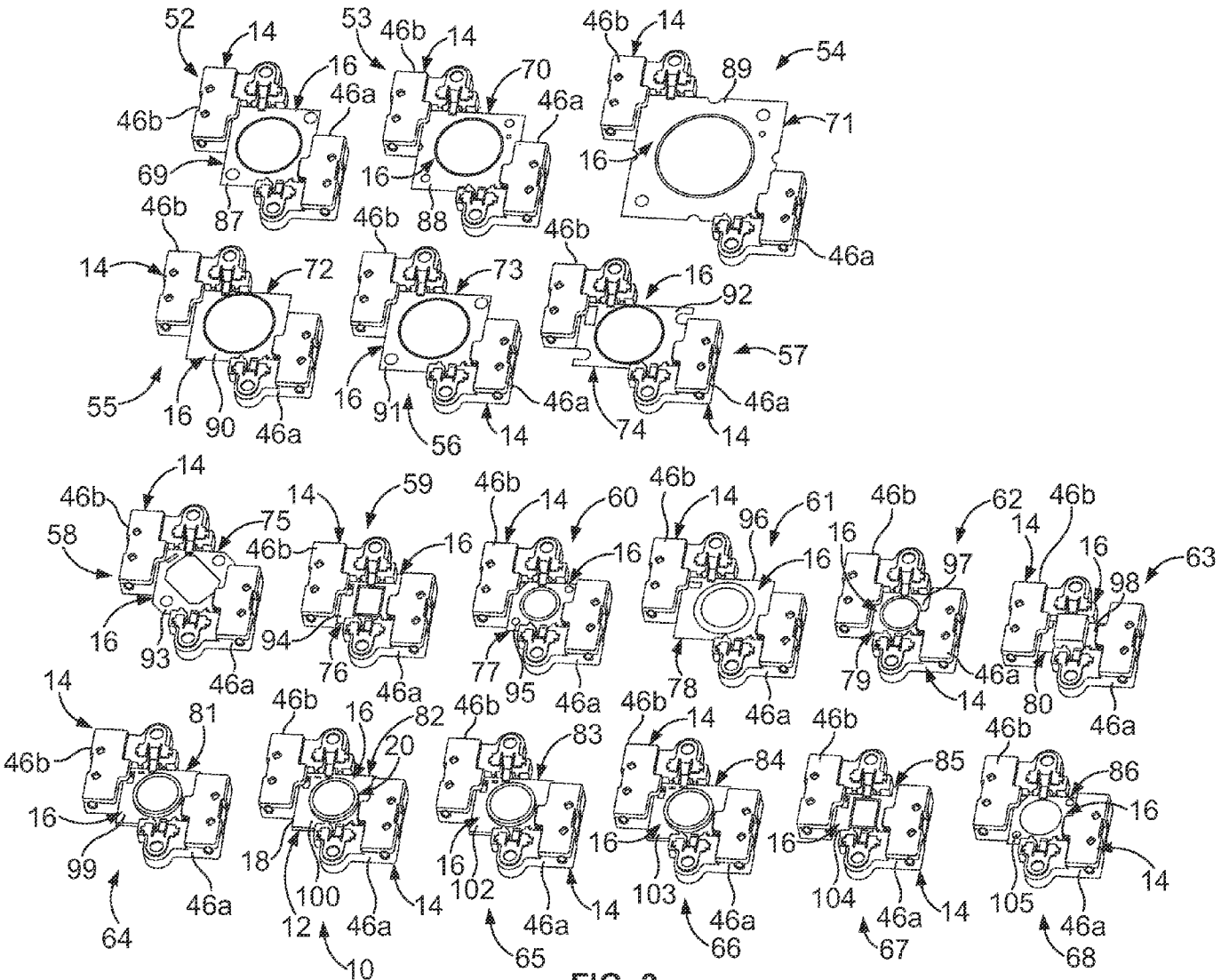
FIG. 3 is a perspective view of exemplary embodiments of a plurality of socket assemblies that each includes the socket housing shown in FIG. 2.

FIG. 3 is a perspective view of exemplary embodiments of a plurality of socket assemblies 10 and 52-68. Each of the socket assemblies 10 and 52-68 includes the socket housing 14. FIG. 3 illustrates the socket housing 14 individually receiving a plurality of different LED packages 12 and 69-86 within the recess 16. More specifically, each of the socket assemblies 10 and 52-68 includes an LED package 12 and 69-86, respectively, held within the recess 16 of the socket housing 14.

Each LED package 12 and 69-86 has a different size. For example, the LED packages 12 and 69-86 include LED PCBs 18 and 87-105, respectively, that each have a different size. As should be apparent from a comparison of FIGS. 2 and 3, within each socket assembly 10 and 52-68, the relative position between the housing segments 46*a* and 46*b* has been adjusted to provide the recess 16 with a size that is configured to receive the particular size of the respective LED PCB 18 and 87-105. Accordingly, the socket housing 14 is configured to individually receive a plurality of differently sized LED packages 12 and 69-86 within the recess 16 via selective adjustment of the size of the recess 16.

FIG. 3 illustrates the recess 16 of the socket housing 14 being adjusted to hold a wide variety of LED packages 12 and 69-86 having a wide variety of sizes, types, and/or the like of LED PCBs 18 and 87-105 and LEDs (e.g., the LED 20) mounted thereto. However, the socket housing 14 is not limited for use with the LED packages 12 and 69-86, but rather the recess 16 of the socket housing 14 may be selectively adjustable to hold other sizes, types, and/or the like of LED packages, LED PCBs, and LEDs than the LED packages, LED PCBs, and LEDs shown herein.

Figure 4:
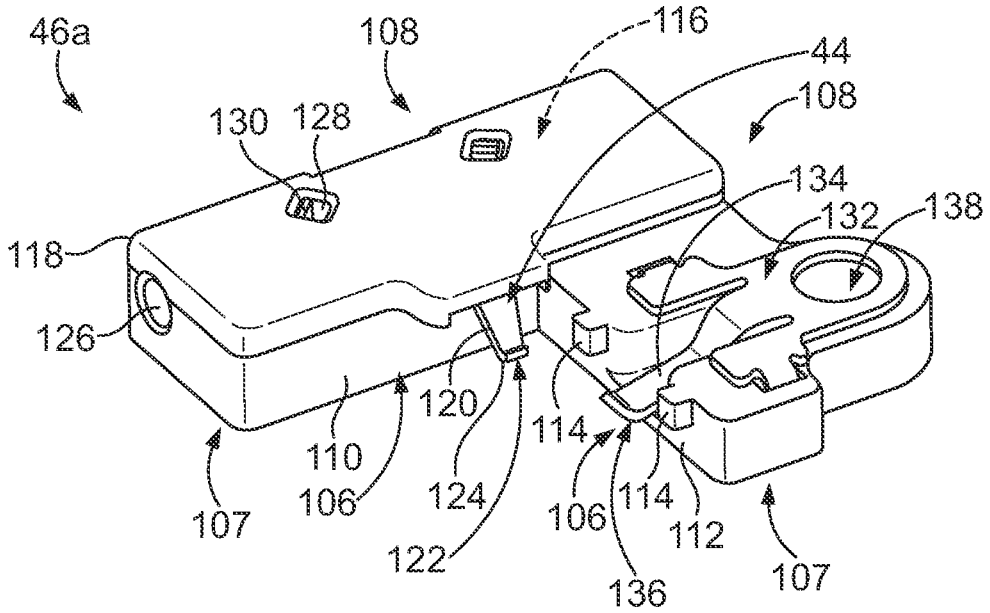
FIG. 4 is a perspective view of an exemplary embodiment of a housing segment of the socket housing shown in FIG. 2.
Figure 5:
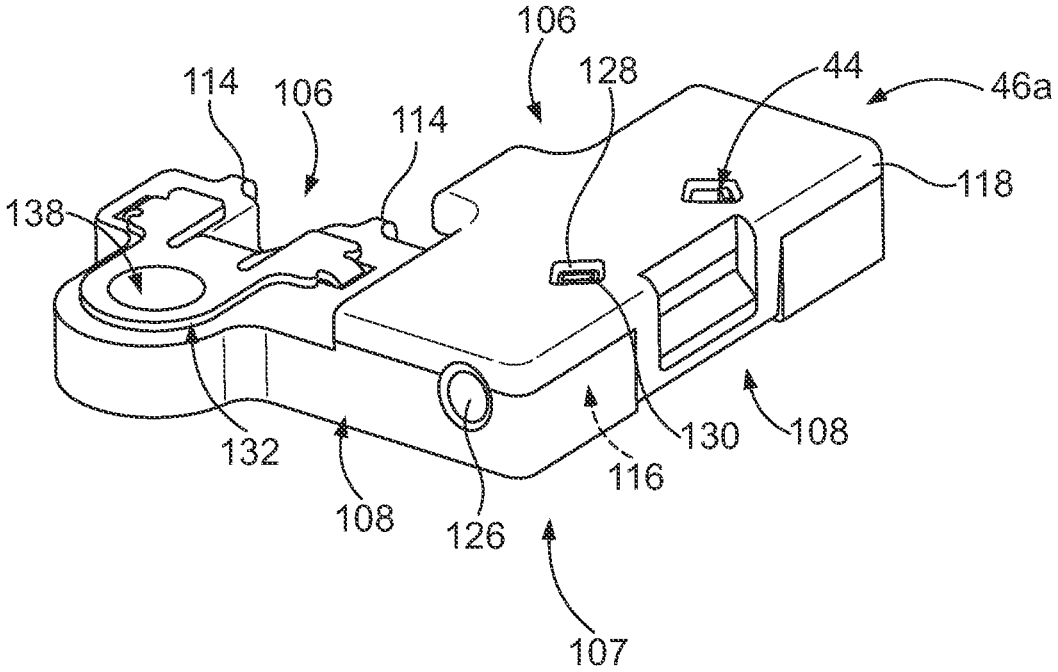
FIG. 5 is a perspective view of the housing segment shown in FIG. 4 viewed from a different angle than FIG. 4.

FIG. 4 is a perspective view of an exemplary embodiment of the housing segment 46*a* of an exemplary embodiment of the socket housing 14. FIG. 5 is a perspective view of the housing segment 46*a* viewed from a different angle than FIG. 4. The housing segment 46*b* is shown in FIG. 1-3. In the exemplary embodiment, the housing segments 46*a* and 46*b* are substantially identical and are hermaphroditic. Accordingly, only the housing segment 46*a* will be described in more detail herein.

The housing segment 46*a* includes an inner side 106 and an outer side 108. The inner side 106 defines a boundary of a portion of the recess 16 (FIGS. 1-3). The inner side 106 includes engagement surfaces 110 and 112 (not visible in FIG. 5) that engage the LED PCB 18 (FIGS. 1 and 3) when the LED package 12 (FIGS. 1 and 3) is received within the recess 16. The housing segment 46*a* includes a mounting side 107 that extends between the inner and outer sides 106 and 108, respectively. The housing segment 46*a* is configured to be mounted to the support structure 48 along the mounting side 107. In the exemplary embodiment, the housing segment 46*a* includes an L-shape. But, the housing segment 46*a* may additionally or alternatively include any other shape(s), which may depend on the shape of the LED PCB 18.

In the exemplary embodiment, the housing segment 46*a* includes one or more securing tabs 114 that extend along the inner side 106. The securing tabs 114 engage the side 22 (FIG. 1) of the LED PCB 18 to facilitate holding the LED package 12 within the recess 16. The securing tabs 114 optionally facilitate locating the LED PCB 18 within the recess 16 and/or operate as anti-rotational features.

The housing segment 46*a* holds one of the power contacts 44 that engages the corresponding power pad 42 (FIG. 1) of the LED PCB 18. More specifically, the housing segment 46*a* includes a contact cavity 116. The power contact 44 is held within the contact cavity 116. Optionally, the housing segment 46*a* includes a removable lid 118 that covers an open top of the contact cavity 116. The power contact 44 includes one or more fingers 120 (not visible in FIG. 5) that extend through, and outwardly along, the inner side 106 of the housing segment 46*a*. The finger 120 extends outwardly along the inner side 106 of the housing segment 46*a* to a mating end 122, which includes a mating interface 124 at which the power contact 44 is configured to engage the corresponding power pad 42 of the LED PCB 18. Although only one is shown, the power contact 44 may include any number of the fingers 120. In some embodiments, the power contact 44 includes two or more fingers 120 that extend outwardly different distances from the inner side 106 of the housing segment 46*a*, which may facilitate that ability of the power contact 44 to engage, and thereby electrically connect to, power pads 42 having different positions on the corresponding LED PCB.

The power contact 44 is configured to supply electrical power to the corresponding power pad 42 of the LED PCB 18 from a source of electrical power (not shown). The power contact 44 is optionally configured to transfer electrical power to a neighboring socket assembly (not shown). The power contact 44 is optionally configured to receive electrical power from a neighboring socket assembly.

The housing segment 46*a* includes one or more wire slots 126 that receiving an electrical wire (not shown) therein. When an electrical wire is received within the wire slot 126, an electrical conductor (not shown) of the electrical wire engages the power contact 44 to establish an electrical connection between the electrical wire and the power contact 44. The electrical wire either supplies electrical power to the power contact 44 or transfers electrical power from the power contact 44 (e.g., to a neighboring socket assembly). The housing segment 46*a* may include any number of the wire slots 126. In the exemplary embodiment, the housing segment 46*a* includes two wire slots 126. Optionally, one of the wire slots 126 receives an electrical wire that supplies electrical power to the power contact 44, while the other wire slot 126 receives an electrical wire that transfers electrical power from the power contact 44.

In the exemplary embodiment, the power contact 44 includes a poke-in contact (not shown) wherein a stripped end of an electrical wire is poked into the poked into the power contact 44 to establish an electrical connection between the electrical wire and the power contact 44. But, any other type of mechanical connection may additionally or alternatively be used to establish the electrical connection between the power contact 44 and an electrical wire. For example, the power contact 44 may include an insulation displacement contact (IDC; not shown) that pierces the insulation of an electrical wire to electrically connect to an electrical conductor of the wire. Moreover, and for example, the power contact 44 may be crimped, welded, and/or otherwise electrically connected to the electrical conductor of an electrical wire.

The housing segment 46*a* optionally includes one or more release openings 128 that expose one or more optional release buttons 130 of the power contact 44. The release buttons 130 can be actuated to release an electrical wire from the power contact 44 such that the electrical wire can be electrically and mechanically disconnected from the power contact 44. Optionally, the housing segment 46*a* is marked to indicate whether the power contact 44 is positive or a negative contact.

Figure 6:
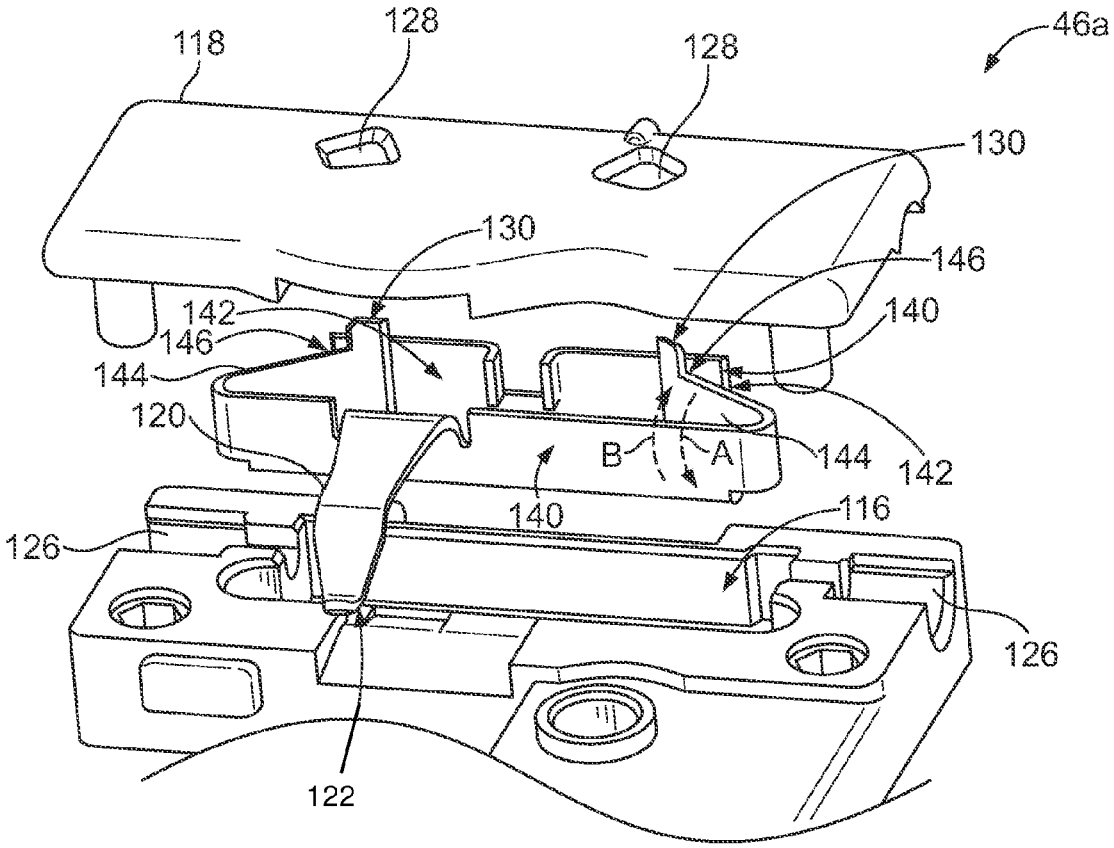
FIG. 6 is an exploded perspective view of a portion of the housing segment shown in FIGS. 4 and 5 illustrating an exemplary embodiment of a power contact of the socket housing shown in FIG. 2.
Figure 7:
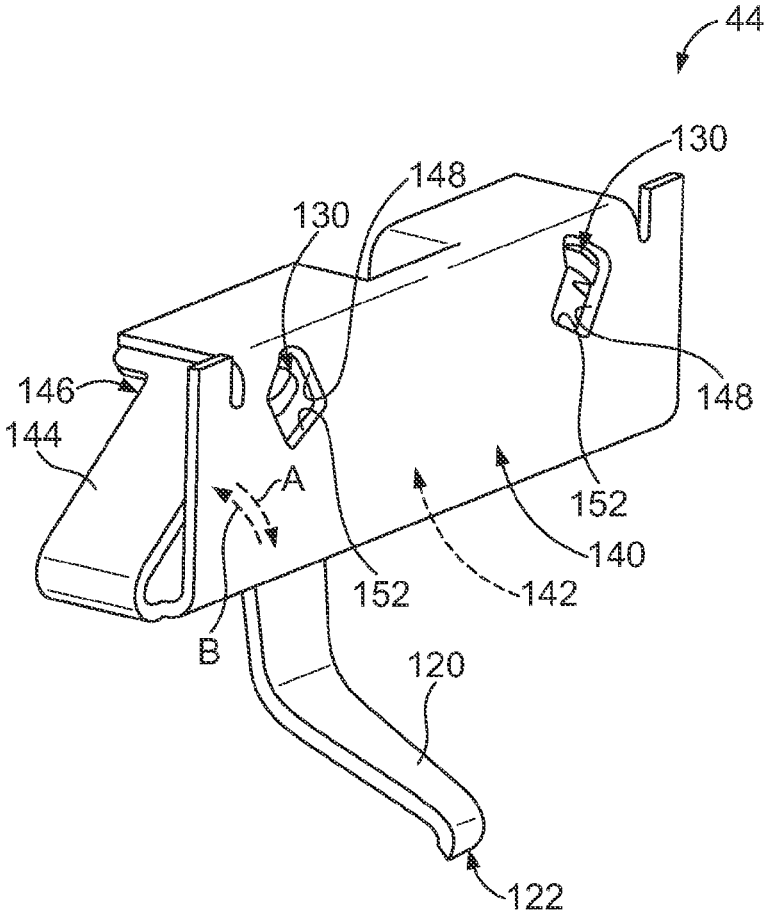
FIG. 7 is a perspective view of the power contact shown in FIG. 6 viewed from a different angle than FIG. 6.

FIG. 6 is an exploded perspective view of a portion of the housing segment 46*a* illustrating an exemplary embodiment of a power contact 44. FIG. 7 is a perspective view of the power contact 44 viewed from a different angle than FIG. 6. The power contact 44 includes a base 140 that is held within the contact cavity 116 (not shown in FIG. 7) of the housing segment 46*a* (not shown in FIG. 7). The finger 120 of the power contact 44 extends outwardly from the base 140 to the mating end 122.

The base 140 includes an internal cavity 142. One or more spring arms 144 extend outwardly from the base 140 into the internal cavity 142 of the base 140. The spring arms 144 enable the power contact 44 to be electrically connected to electrical conductors of electrical wires. More specifically, each spring arm 144 includes an end 146 at which the spring arm 144 engages the electrical conductor of the corresponding electrical wire. As described above, in the exemplary embodiment, the power contact 44 is a poke-in contact wherein a stripped end of an electrical wire is poked into the power contact 44. More specifically, as a stripped end of an electrical wire is inserted into a wire slot 126 (not shown in FIG. 7) of the housing segment 46, the electrical conductor that is exposed at the end of the electrical wire engages, and thereby deflects in the direction A, a corresponding one of the spring arms 144. The bias of the spring arm in the direction B facilitates holding the end 146 of the spring arm 142 in engagement with the electrical conductor of the electrical wire to facilitate providing a reliable electrical connection therebetween. Although two springs arms 144 are shown for electrically connecting the power contact 44 to two electrical wires, the power contact 44 may include any number of spring arms 144 for electrically connection to any number of electrical wires.

As described above, the power contact 44 optionally includes one or more release buttons 130 that can be actuated to release an electrical wire from the power contact 44. In the exemplary embodiment, the release buttons 130 are tabs that extend outwardly at the end 146 of the corresponding spring arm 144. The release buttons 130 extend into corresponding openings 148 (not visible in FIG. 6) in the base 140. Moreover, the release buttons 130 are exposed through the release openings 128 of the housing segment 46*a*. A release button 130 is actuated by moving the release button 130 in the direction A to thereby move the corresponding spring arm 144 in the direction A. As the spring arm 144 moves in the direction A, the electrical conductor of the corresponding electrical wire disengages from the spring arm 144 such that the electrical conductor of the corresponding electrical wire can be removed from the internal cavity 142 of the base 140 and from the contact cavity 116 of the housing segment 46*a*. Optionally, the release buttons 130 are configured to engage a stop surface 152 of the corresponding opening 148 to prevent the over-travel of the spring arms 144 in the direction A. The stop surface 152 may prevent the spring arms 144 from being over-stressed by moving too far in the direction A. Although the power contact 44 includes two release buttons 130 and two openings 148, the power contact 44 may include any number of release buttons 130 and any number of openings 148 for releasing any number of electrical wires from the power contact 44.

Referring again to FIGS. 4 and 5, one or more springs 132 is optionally held by the housing segment 46*a*. The housing segment 46*a* may hold any number of the springs 132. In the exemplary embodiment, the housing segment 46*a* holds a single spring 132. The spring 132 is configured to engage the LED PCB 18 to apply a biasing force to the LED PCB 18, which biases the LED PCB 18 toward the support structure 48. More specifically, the spring 132 includes one or more fingers 134 (not visible in FIG. 5) that extend outwardly along the inner side 106 of the housing segment 46*a* to an engagement end 136. The finger 134 is a resiliently deflectable spring that engages the side 22 of the LED PCB 18. When the LED PCB 18 is received within the recess 16 of the socket housing 14, the engagement end 136 of the finger 134 engages the side 22 of the LED PCB 18 and is deflected thereby in a direction away from the support structure 48. In the deflected position, the finger 134 exerts the biasing force on the side 22 of the LED PCB 18 that acts in a direction toward the support structure 48. Although the spring 132 only includes a single finger 134 in the exemplary embodiment, the spring 132 may include any number of the fingers 134.

Figure 8:
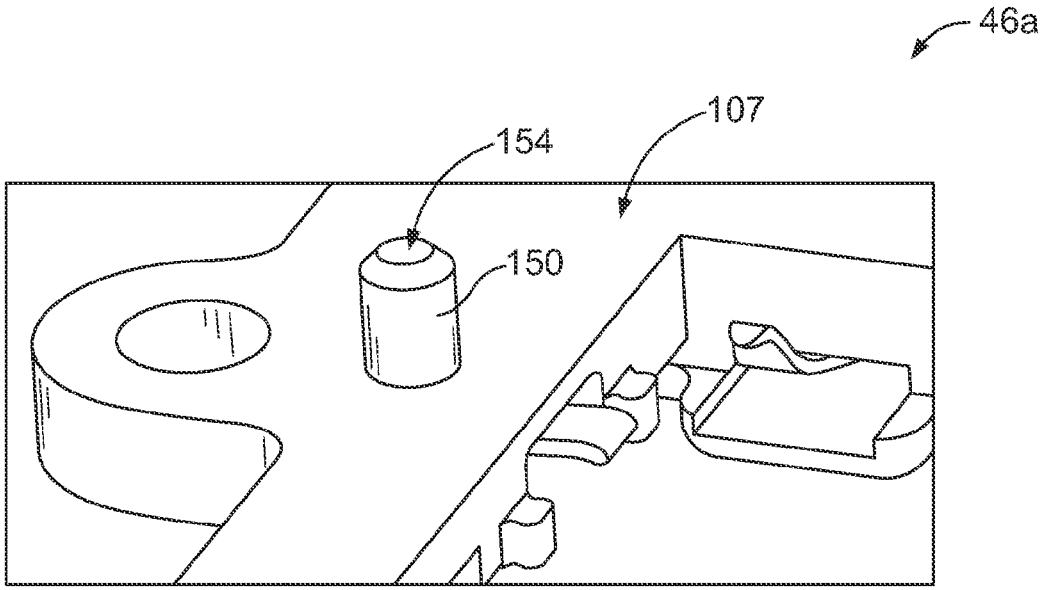
FIG. 8 is a perspective view of a portion of an exemplary embodiment of a mounting side of the housing segment shown in FIGS. 4-6.

The housing segment 46*a* may include one or more mounting features 138 for securing the socket housing 14 to the support structure 48 and/or for mechanically connecting the socket assembly 10 to a neighboring socket assembly. In the exemplary embodiment, the mounting feature 138 is an opening that is configured to receive a fastener (not shown) therethrough. But, the mounting feature 138 may additionally or alternatively be any other type of mounting feature, such as, but not limited to, a post, a latch, a spring, a snap-fit member, an interference-fit member, and/or the like. The housing segment 46*a* may include one or more alignment and/or anti-rotation features for aligning the housing segment 46*a* relative to the support structure 48 and/or for preventing rotation of the housing segment 46*a*. For example, the housing segment 46*a* may include a post 150 (FIG. 8) that extends outwardly on the mounting side 107 of the housing segment 46*a* for reception within an opening (not shown) within the support structure 48. FIG. 8 is a perspective view of a portion of an exemplary embodiment of the mounting side 107 of the housing segment 46*a*. The post 150 extends outwardly from the mounting side 107 to an end 154. The post 150 is configured to be received within the corresponding opening (not shown) within the support structure 48 (FIGS. 1 and 2) to locate the housing segment 46*a* along the support structure 48. Reception of the post 150 within the corresponding opening of the support structure 48 may additionally or alternatively facilitate preventing rotation of the housing segment 46*a* during installation of the socket housing 14 on the support structure 48 and/or during installation of an LED package within the socket housing 14. Moreover, the post 150 may be received within the corresponding opening with an interference-fit, a snap-fit, and/or the like to facilitate securing the socket housing 14 to the support structure 48. In addition or alternatively to the post 150, one or more other types of alignment and/or anti-rotation features may be provided.

Referring again to FIGS. 4 and 5, the housing segment 46*a* optionally includes one or more optical mounting components (not shown) for mounting an optic to the socket housing 14. For example, the optical mounting component may include a clip (not shown) that is held by the mounting feature 138 of the housing segment 46*a*. The clip may include one or more structures for holding an optic, such as, but not limited to, an opening, a spring and/or flex member, an interference-fit structure, a snap-fit structure, and/or the like. Another example of an optical mounting component includes a structure of the housing segment 46*a*, such as, but not limited to, an opening, a spring and/or flex member, an interference-fit structure, a snap-fit structure, and/or the like.

Referring again to FIG. 1, the LED package 12 is shown received within the recess 16 of the socket housing 14. The housing segments 46*a* and 46*b* of the socket housing 14 are wrapped around opposite corners 34 and 38 of the LED PCB 18 in engagement therewith. The engagement surfaces 110 of the housing segments 46*a* and 46*b* are engaged with the edges 28 and 26, respectively, of the LED PCB 18, while the engagement surfaces 112 of the housing segments 46*a* and 46*b* are engaged with the edges 32 and 30, respectively. The engagement between the surfaces 110 and 112 of the housing segments 46*a* and 46*b* and the LED PCB 18 facilitates securing the LED package 12 within the recess 16. The securing tabs 114 of the housing segments 46*a* and 46*b* are engaged with the side 22 of the LED PCB 18 to facilitate holding the LED PCB 18 within the recess 16 between the securing tabs 114 and the support structure 48. The securing tabs 114 optionally apply a force to the LED PCB 18 that acts in a direction toward the support structure 48. Optionally, the force applied by the securing tabs 114 forces the side 24 of the LED PCB 18 into engagement with the support structure 48 or an intermediate member (e.g., a thermal interface material; not shown) that extends between the LED PCB 18 and the support structure 48. The engagement between the LED PCB 18 and the support structure 48 or intermediate member may facilitate the transfer of heat away from the LED package 12.

Once the socket housing 14 is secured to the support structure, the springs 132 held by the housing segments 46*a* and 46*b* are engaged with the LED PCB 18 to apply the biasing force that biases the LED PCB 18 toward the support structure 48. More specifically, the engagement ends 136 of the fingers 134 of the springs 132 engage the side 22 of the LED PCB 18 and exert the biasing force on the side 22 of the LED PCB 18. As described above, the biasing force acts in a direction toward the support structure 48 such that the springs 132 bias the LED PCB 18 toward the support structure 48. Optionally, the springs 132 bias the side 24 of the LED PCB 18 into engagement with the support structure 48 or the intermediate member (if provided) that extends between the LED PCB 18 and the support structure 48. The engagement between the LED PCB 18 and the support structure 48 or intermediate member may facilitate the transfer of heat away from the LED package 12.

The fingers 120 of the power contacts 44 held by the housing segments 46*a* and 46*b* extend into the recess 16. The mating interfaces 124 of the fingers 120 engage the corresponding power pads 42 of the LED PCB 18 to establish an electrical connection between the power contacts 44 and the power pads 42 for supplying electrical power to the LED package 12.

Figure 9:
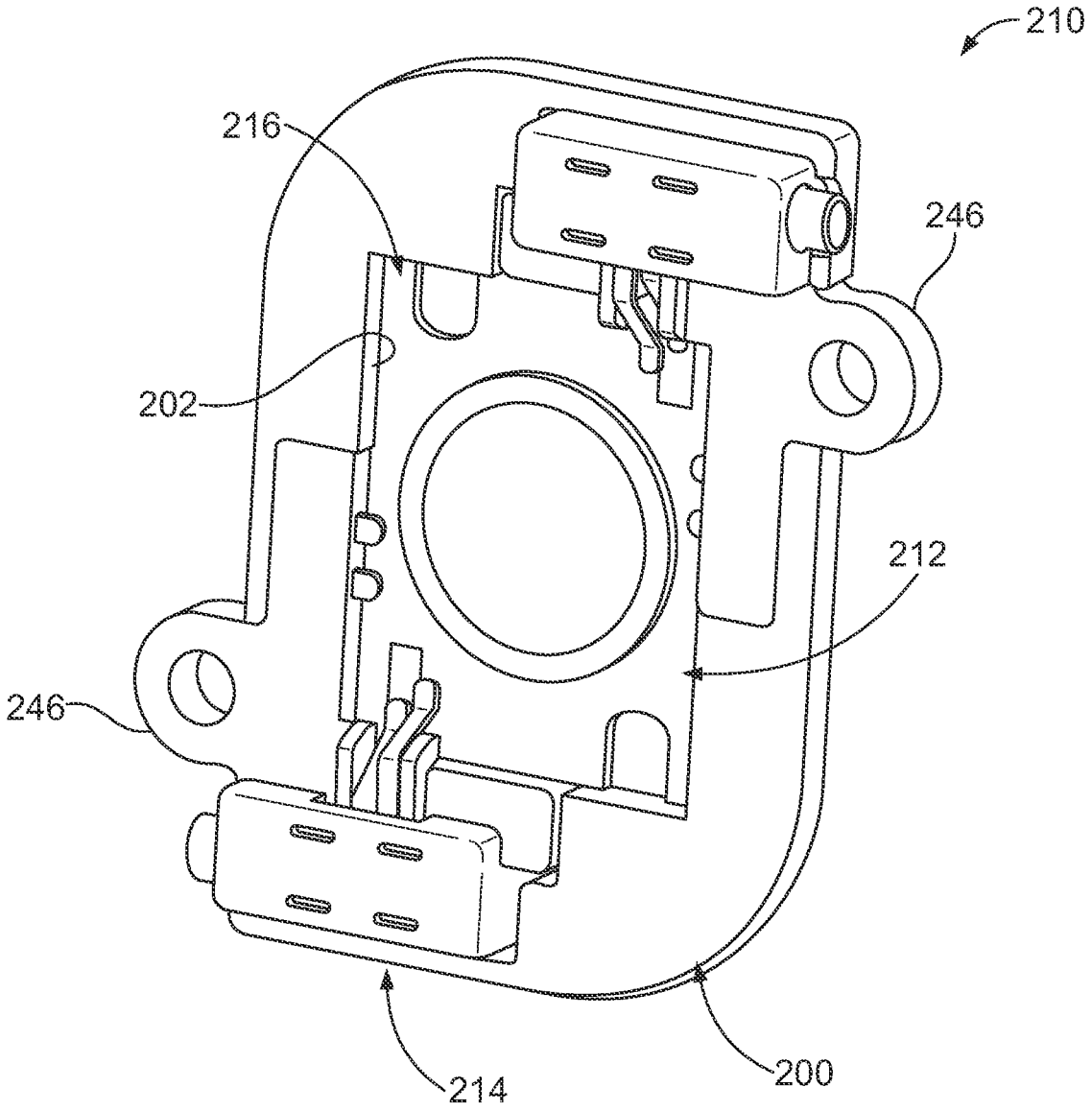
FIG. 9 is a perspective view of another exemplary embodiment of a socket assembly.

Optionally, the socket housing 14 includes a carrier that interconnects the housing segments 46*a* once the relative position between the housing segments 46*a* and 46*b* has been adjusted for the particular LED package held thereby. For example, FIG. 9 is a perspective view of another exemplary embodiment of a socket assembly 210. The socket assembly 210 includes an LED package 212 and a socket housing 214. The socket housing 214 includes a recess 216 that receives the LED package 212 therein. The socket housing 214 includes two or more discrete housing segments 246 that cooperate to define the recess 216. A relative position between the housing segments 246 is selectively adjustable such that a size of the recess 216 is selectively adjustable for individually receiving a plurality of differently sized LED packages within the recess 216.

Once the relative position between the housing segments 246 has been adjusted for the particular LED package 212 held thereby, the housing segments 246 are mechanically connected together using a carrier 200. The carrier 200 extends between and interconnects the housing segments 246 of the socket housing 214. Optionally, the carrier 200 includes one or more openings 202 that receives the housing segments 246 therein with a snap-fit and/or interference-fit connection. In addition or alternatively, the carrier 200 may be secured to the housing segments 246 using a latch, a threaded or other type of fastener, heat staking, ultrasonic or another type of welding, and/or another structure. The carrier 200 may be defined by a single body, as is shown in FIG. 9, or may include two or more discrete bodies that engage the housing segments 246. The carrier 200 may be secured to a support structure (not shown) to which the socket assembly 210 is mounted in addition or alternatively to one or more of the housing segments 246.

Figure 10:
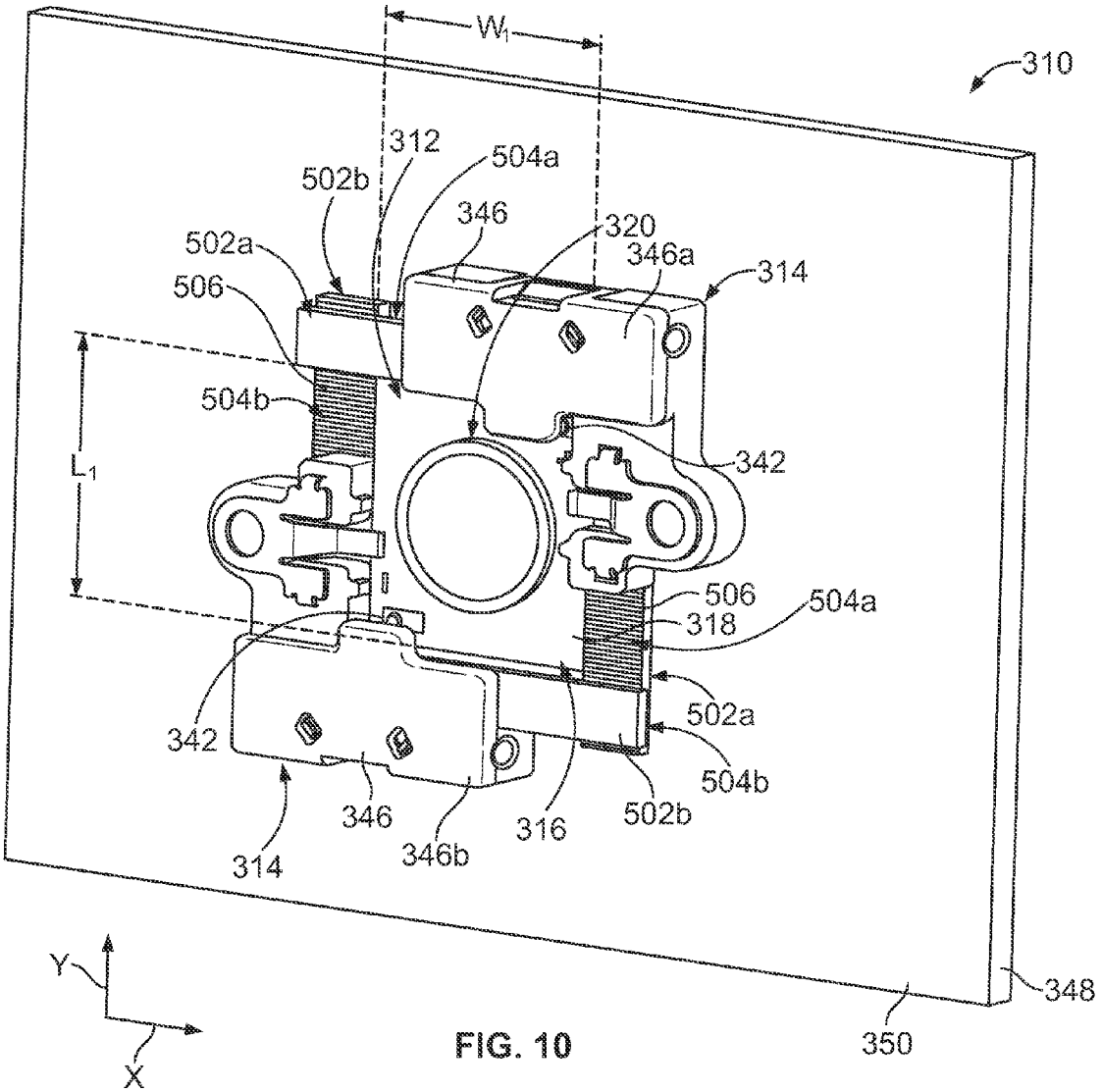
FIG. 10 is a perspective view of another exemplary embodiment of a socket assembly illustrating the socket assembly mounted to an exemplary support structure.

FIG. 10 is a perspective view of another exemplary embodiment of a socket assembly 310. The socket assembly 310 includes an LED package 312 and a socket housing 314. The socket housing 314 includes a recess 316 that receives the LED package 312 therein. The LED package 312 includes an LED PCB 318 with an LED 320 mounted thereto. The LED PCB 318 includes a plurality of power pads 342. The socket assembly 310 is mounted to a support structure 348.

The socket housing 314 includes two or more discrete housing segments 346 that cooperate to define the recess 316. As will be described below, the housing segments 346 engage each other when the LED package 312 is held within the recess 316. In the exemplary embodiment, the socket housing 314 includes two discrete housing segments 346*a* and 346*b*. As will be described below, a relative position between the housing segments 346*a* and 346*b* is selectively adjustable such that a size of the recess 316 is selectively adjustable for individually receiving a plurality of differently sized LED packages within the recess 316. Optionally, the discrete housing segments 346*a* and 346*b* are substantially identical and/or hermaphroditic.

Figure 11:
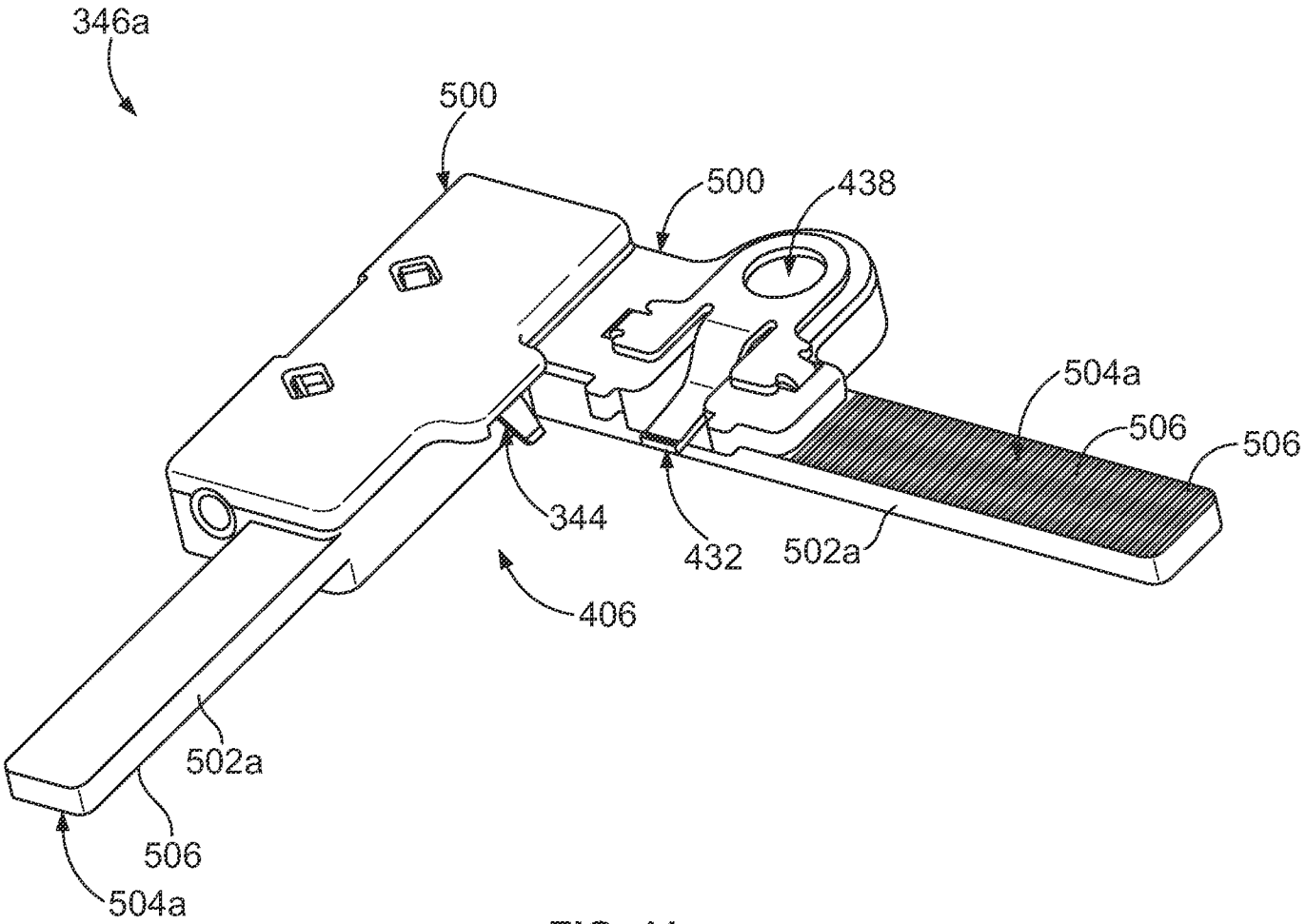
FIG. 11 is a perspective view of an exemplary embodiment of a housing segment of an exemplary embodiment of a socket housing of the socket assembly shown in FIG. 10.
Figure 14:
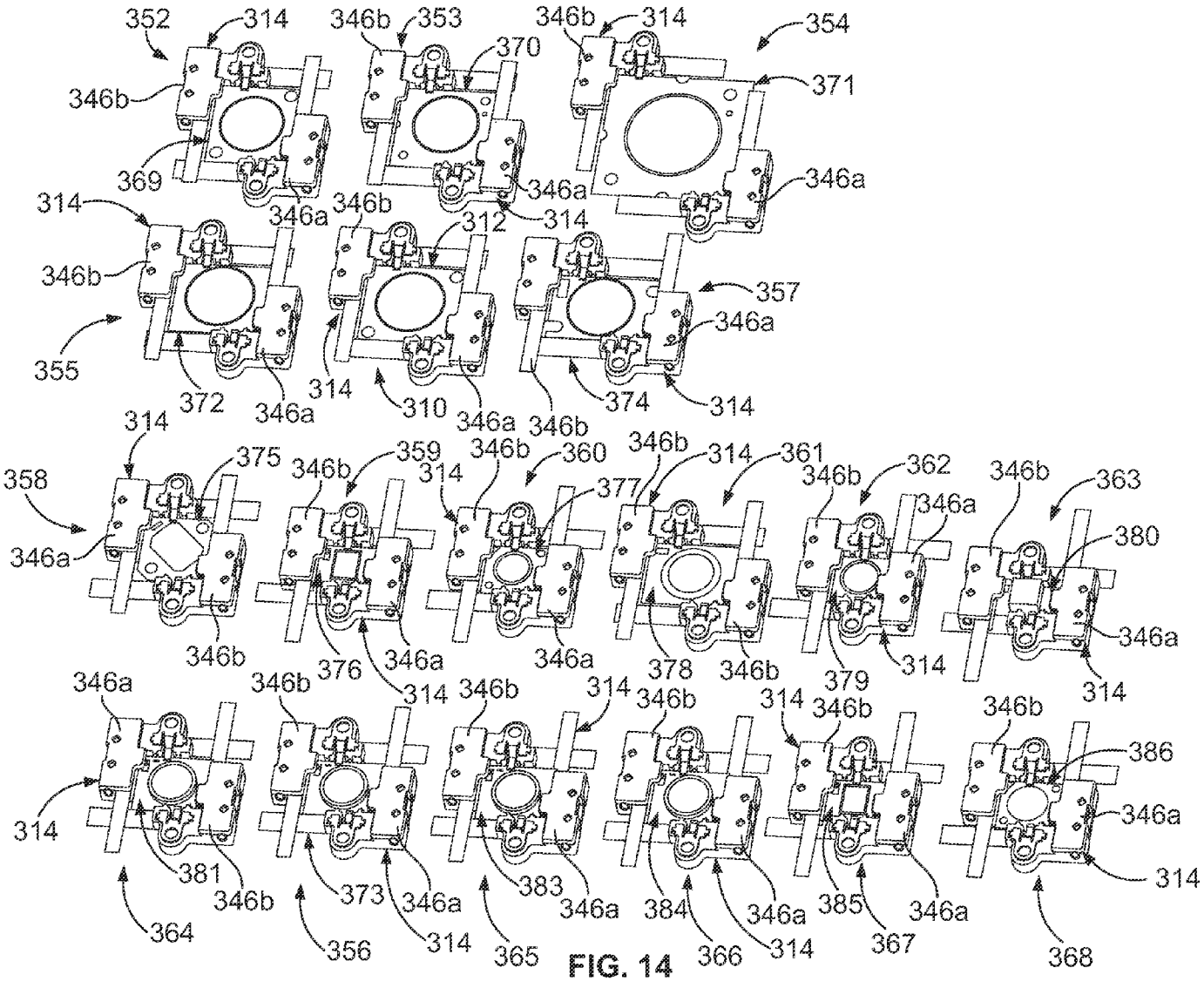
FIG. 14 is a perspective view of exemplary embodiments of a plurality of socket assemblies that each includes the socket housing of the socket assembly shown in FIG. 10.

FIG. 11 is a perspective view of an exemplary of the housing segment 346*a* of an exemplary embodiment of the socket housing 314. The housing segment 346*b* is shown in FIGS. 10 and 14. In the exemplary embodiment, the housing segments 346*a* and 346*b* are substantially identical and are hermaphroditic. Accordingly, only the housing segment 346*a* will be described in more detail herein.

The housing segment 346*a* includes an inner side 406 that defines a boundary of a portion of the recess 316 (FIGS. 10 and 14) and that engages the LED PCB 318 (FIGS. 10 and 14). The housing segment 346*a* includes a base sub-segment 500 and arms 502*a* that extend outwardly from the base sub-segment 500. The arms 502*a* include engagement sides 504*a*. The engagement sides 504*a* are configured to engage engagement sides 504*b* (FIG. 10) of corresponding arms 502*b* (FIG. 10) of the housing segment 346*b*, at least when the recess 316 holds an LED package 12 that is below a predetermined size. Each arm 502*a* is slidable on (in engagement with) and along the corresponding arm 502*b*, and vice versa. The engagement side 504*a* of the arms 502*a* optionally includes a texture or other structure that facilitates further (in addition to the engagement) connecting the arms 502*a* to the corresponding arms 502*b*. For example, in the exemplary embodiment, the engagement side 504*a* of the arms 502*a* includes a texture 506. The texture 506 may enhance a chemical and/or mechanical bond between an arm 502*a* and an arm 502*b*. For example, the texture 506 may facilitate ultrasonic welding of an arm 502*a* to an arm 502*b*. In addition or alternative to the texture 506, the texture or other structure of the engagement side 504*a* may include any other structure that facilitates further (in addition to the engagement) connecting the arms 502*a* to the corresponding arms 502*b*, and vice versa. Optionally, the arm 502*a* and/or the arm 502*b* includes a texture or other structure that facilitates sliding of the arm 502*a* along the arm 502*b*, and vice versa.

Figure 12:
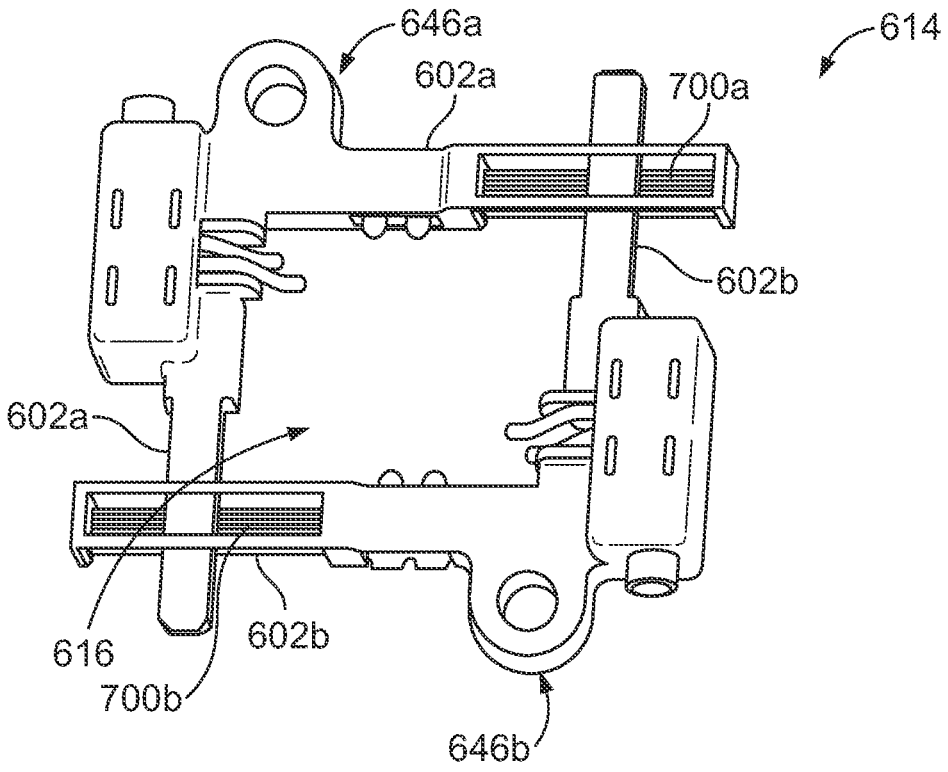
FIG. 12 is a perspective view of another exemplary embodiment of a socket housing.

FIG. 12 is a perspective view of another exemplary embodiment of a socket housing 614. The socket housing 614 includes two or more discrete housing segments 646*a* and 646*b* that cooperate to define a recess 616. A relative position between the housing segments 646*a* and 646*b* is selectively adjustable such that a size of the recess 616 is selectively adjustable for individually receiving a plurality of differently sized LED packages within the recess 616.

Figure 13:
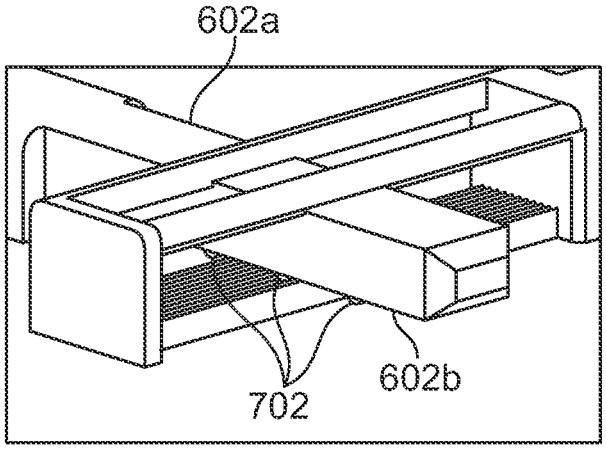
FIG. 13 is a perspective view of a portion of the socket housing shown in FIG. 12.

The housing segments 646*a* and 646*b* include arms 602*a* and 602*b*, respectively. Each arm 602*a* is slidable along the corresponding arm 602*b*, and vice versa. More specifically, one of the arms 602*a* of the housing segment 646*a* includes a slot 700*a* that receives at least a portion of a corresponding arm 602*b* of the housing segment 646*b* therein. The arm 602*b* is slidable within the slot 700*a* and along the arm 602*a*. Similarly, one of the arms 602*b* of the housing segment 646*b* includes a slot 700*b* that receives at least a portion of a corresponding arm 602*a* of the housing segment 646*a* therein. The arm 602*a* is slidable within the slot 700*b* and along the arm 602*b*. Optionally, the arm 602*a* and/or the arm 602*b* includes a texture or other structure that facilitates forcible sliding of the arm 602*a* along the arm 602*b*, and vice versa (e.g., a texture or other structure of an arm 602*a* that cooperates with a texture or other structure of an arm 602*b*). The texture or other structure of the arms 602*a* and/or 602*b* may provide an interference force that facilitates retaining the arms 602*a* and 602*b* in a selected position relative to each other. Referring now to FIG. 13, in the exemplary embodiment, one of the arms 602*b* includes a plurality of ramps 702 that extend transversely across the arm 602*b*. The ramps 702 engage and ride along the corresponding arm 602*a* when the arm 602*b* slides within the slot 700*a* of the corresponding arm 602*a*. In the exemplary embodiment, one of the arms 602*a* also includes a plurality of ramps (not shown) that extend transversely across the arm 602*a* and engage and ride along the corresponding arm 602*b*. In addition or alternative to the ramps 702, the texture or other structure of the arms 602*a* and/or 602*b* may include any other structure that facilitates sliding of the arms 602*a* and 602*b* relative to each other, such as, but not limited to, one or more tracks (not shown) and/or guide extensions (not shown) that are received within the track(s).

Referring again to FIG. 11, the housing segment 346*a* may include one or more mounting features 438 for securing the socket housing 314 to the support structure 348 (FIG. 10) and/or for mechanically connecting the socket assembly 310 to a neighboring socket assembly. The housing segment 346*a* may include one or more alignment and/or anti-rotation features (not shown) for aligning the housing segment 346*a* relative to the support structure 348 and/or for preventing rotation of the housing segment 346*a*. In the exemplary embodiment, the housing segment 346*a* includes an L-shape. But, the housing segment 346*a* may additionally or alternatively include any other shape(s), which may depend on the shape of the LED PCB 318.

The housing segment 346*a* holds one or more power contacts 344 that engages the corresponding power pad 342 of the LED PCB 318 for supplying the LED 320 with electrical power from a source (not shown) of electrical power. One or more springs 432 is optionally held by the housing segment 346*a*. The spring 432 is configured to engage the LED PCB 318 to apply a biasing force to the LED PCB 318, for example to bias the LED PCB 318 toward the support structure 348. Optionally, the housing segment 346*a* holds one or more optical mounting components (not shown) for mounting an optic to the socket housing 314.

Referring again to FIG. 10, the socket housing 314 is shown holding LED package 312 within the recess 316. The LED package 312 is sized such that, when received within the recess 316, each of the arms 502*a* of the housing segment 346*a* is engaged with the corresponding arm 502*b* of the housing segment 346*b* to mechanically connect the arms 502*a* to the arms 502*b*. More specifically, the engagement sides 504*a* of the arms 502*b* are engaged with the engagement sides 504*b* of the corresponding arms 502*b*.

The relative position between the housing segments 346*a* and 346*b* is selectively adjustable such that a size of the recess 316 is selectively adjustable. For example, a relative position between each arm 502*a* of the housing segment 346*a* and the corresponding arm 502*b* of the housing segment 346*b* is selectively adjustable to adjust the size of the recess 316. Each arm 502*a* is slidable on (in engagement with) and along the corresponding arm 502*b*, and vice versa. As will be described below, the arms 502*a* are optionally further connected (in addition to the engagement) to the arms 502*b*. In such embodiments wherein corresponding arms 502*a* and 502*b* are further connected (in addition to the engagement) together, the relative position between the corresponding arms 502*a* and 502*b* is only selectively adjustable before the arms 502*a* and 502*b* are further connected (in addition to the engagement) together.

Each housing segment 346*a* and 46*b* can be moved relative to the other housing segment 346*a* or 346*b* along an X coordinate axis and along a Y coordinate axis, as shown in FIG. 10. The relative position between the housing segments 346*a* and 346*b* along the X and Y coordinate axes defines the size of the recess 316. Accordingly, the size of the recess 316 is selectively adjustable. In the example shown in FIG. 10, the housing segments 346*a* and 346*b* are movable along a surface 350 of the support structure 348 relative to each other to adjust the size of the recess 316. In other words, the mounting location on the support structure 348 of each of the housing segments 346*a* and 346*b* can be changed relative to the mounting location of the other housing segment 346*a* or 346*b* to adjust the size of the recess 16.

In the example shown in FIG. 10, the recess 316 includes a shape having a length $L_1$ and a width $W_1$. The length $L_1$ of the recess 316 is adjustable by moving the housing segments 346*a* and 346*b* relative to each other along the Y coordinate axis. The width $W_1$ of the recess 316 is adjustable by moving the housing segments 346 and 346*b* relative to each other along the X coordinate axis. Accordingly, the size of the recess 316 is adjustable by adjusting the width $W_1$ of the recess 316 and/or by adjusting the length $L_1$ of the recess 316.

The adjustability of the recess size enables the size of recess 316 to be selected for a particular LED package having a particular size (e.g., the particular size of an LED PCB of the particular LED package). In other words, the size of the recess 316 can be selected to configure the recess 316 to receive (e.g., be complementary with) the size of a particular LED package. For example, the length $L_1$ and/or the width $W_1$ of the recess 316 can be selected to be approximately the same, or slightly larger, than the length and/or the width, respectively, of a particular LED package. Accordingly, the socket housing 314 is configured to individually receive a plurality of differently sized LED packages within the recess 316 via selective adjustment of the size of the recess 316.

Once the relative position between the housing segments 346*a* and 346*b* has been adjusted for the particular LED package held thereby, each arm 502*a* may be further (in addition to the engagement) connected to the corresponding arm 502*b* using any method, structure, means, and/or the like, such as, but not limited to, heat staking, a threaded or other type of fastener, ultrasonic or another type of welding, an adhesive, a band, a clip, and/or the like.

FIG. 14 is a perspective view of exemplary embodiments of a plurality of socket assemblies 310 and 352-368. Each of the socket assemblies 310 and 352-368 includes the socket housing 314. FIG. 14 illustrates the socket housing 314 individually receiving a plurality of different LED packages 312 and 369-386 within the recess 316. More specifically, each of the socket assemblies 310 and 352-368 includes an LED package 312 and 369-386, respectively, held within the recess 316 of the socket housing 314.

Each LED package 312 and 369-386 has a different size. As should be apparent from a comparison of FIGS. 10 and 14, within each socket assembly 310 and 352-368, the relative position between the housing segments 346*a* and 346*b* has been adjusted to provide the recess 316 with a size that is configured to receive the particular size of the respective LED package 312 and 369-386. Accordingly, the socket housing 314 is configured to individually receive a plurality of differently sized LED packages 312 and 369-386 within the recess 316 via selective adjustment of the size of the recess 316.

FIG. 14 illustrates the recess 316 of the socket housing 314 being adjusted to hold a wide variety of LED packages 312 and 369-386 having a wide variety of sizes, types, and/or the like of LED PCBs and LEDs mounted thereto. However, the socket housing 314 is not limited for use with the LED packages 312 and 369-386, but rather the recess 316 of the socket housing 314 may be selectively adjustable to hold other sizes, types, and/or the like of LED packages, LED PCBs, and LEDs than the LED packages, LED PCBs, and LEDs shown herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A socket housing for light emitting diode (LED) packages having an LED printed circuit board (PCB) defined by a first edge, a second edge, a third edge and a fourth edge, the first and second edges meeting at a first corner, the third and fourth edges meeting at a second corner, the first, second, third and fourth edges bounding a surface of the LED PCB that extends length-wise and width-wise, the socket housing comprising separately manufactured first and second housing segments having mounting sides configured to be mounted to and engage a support structure, the mounting sides extend along a length axis and a width axis, the length axis and the width axis being parallel to the mounting sides and to the support structure, the first housing segment having surfaces receiving the first corner and extending along the first and second edges of the LED PCB, the second housing segment having surfaces receiving the second corner and extending along the third and fourth edges of the LED PCB, the first and second housing segments define a recess therebetween for receiving an LED package therein, the first and second housing segments being configured to engage the edges and corners of the LED PCB of the LED package to secure the LED package within the recess, wherein a relative position between the first and second housing segments is selectively adjustable such that at least one of a length or a width of the recess is selectively adjustable along the length axis and the width axis, respectively, for receiving differently sized LED packages therein.

2. The socket housing of claim 1, wherein the first housing segment comprises a first arm extending along and engaging the first edge and a second arm extending along and engaging the second edge, and the second housing segment comprises a first arm extending along and engaging the third edge and a second arm extending along and engaging the fourth edge, wherein the first and second arms of the first housing segment are variably positionable relative to the first and second arms of the second housing segment such that both the length and the width of the recess are adjustable.

3. The socket housing of claim 1, wherein the first housing segment comprises a first arm and the second housing segment comprises a second arm, the first and second arms being engaged with each other to mechanically connect the first and second housing segments together, wherein the first and second arms are engaged such that the first and second arms can float relative to each other to selectively adjust the size of the recess.

4. The socket housing of claim 1, wherein the first and second housing segments do not engage each other.

5. The socket housing of claim 1, wherein the socket housing further comprises a carrier, the first and second housing segments being interconnected by the carrier.

6. The socket housing of claim 1, wherein the first and second housing segments are at least one of hermaphroditic or substantially identical.

7. The socket housing of claim 1, where the mounting sides of the first and second housing segments are co-planar for mounting to the support structure, and wherein the first and second housing segments comprise mounting features configured to mount the socket housing to the support structure.

8. The socket housing of claim 1, wherein at least one of the first and second housing segments includes a wire slots that is configured to receive an electrical wire therein.

9. The socket housing of claim 1, wherein the socket assembly is configured to be mounted to the support structure, at least one of the first and second housing segments holding a spring that is configured to engage the LED PCB and apply a biasing force that biases the LED PCB in a direction toward the support structure.

10. A socket assembly comprising:

a first light emitting diode (LED) package having a first LED printed circuit board (PCB) with a first edge, a second edge, a third edge and a fourth edge, the first, second, third and fourth edges bounding a top surface extending a length and a width and with an LED mounted to the top surface, the first LED package having a power pad configured to receive power from a power source to power the LED; and a socket housing having a recess that receives the first LED package therein, the socket housing comprising first and second housing segments that engage the first LED PCB to secure the first LED package within the recess, the first housing segment having a first arm extending along and engaging the first edge and a second arm extending along and engaging the second edge, the second housing segment having a first arm extending along and engaging the third edge and a second arm extending along and engaging the fourth edge, wherein a relative position between the first and second housing segments is selectively adjustable such that at least one of a length or a width of the recess is selectively adjustable for receiving at least one second LED package that includes a second LED PCB that is differently sized relative to the first LED PCB such that the second LED PCB has at least one of a different length or width than the first LED package.

11. The socket assembly of claim 10, wherein the first LED PCB comprises opposite first and second corners, the first housing segment being wrapped around the first corner in engagement therewith, the second housing segment being wrapped around the second corner in engagement therewith.

12. The socket assembly of claim 10, wherein the power pad comprises first and second power pads of the LED PCB, the socket assembly further comprising first and second power contacts held by the first and second housing segments, respectively, the first power contact being engaged and electrically connected with the first power pad, the second power contact being engaged and electrically connected with the second power pad.

13. The socket assembly of claim 10, wherein the socket housing is configured such that both the length and the width of the recess are adjustable.

14. A socket housing for light emitting diode (LED) packages having an LED printed circuit board (PCB) defined by a first edge, a second edge, a third edge and a fourth edge, the first and second edges meeting at a first corner, the third and fourth edges meeting at a second corner, the first, second, third and fourth edges bounding a surface of the LED PCB that extends length-wise and width-wise, the socket housing comprising first and second housing segments that define a recess therebetween for receiving an LED package therein, the first and second housing segments being configured to engage the LED PCB of the LED package to secure the LED package within the recess, the first housing segment having a first arm extending along and engaging the first edge and a second arm extending along and engaging the second edge, the second housing segment having a first arm extending along and engaging the third edge and a second arm extending along and engaging the fourth edge, the first and second arms of the first housing segment being engaged with the first and second arms of the second housing segment at variable positions to mechanically connect the first and second housing segments together, wherein a relative position between the first and second arms is selectively adjustable such that at least one of a width or a length of the recess is selectively adjustable.

15. The socket housing of claim 14, wherein the second arm comprises a slot that receives at least a portion of the first arm therein, the first arm being slidable within the slot of the second arm to selectively adjust the relative position between the first and second arms.

16. The socket housing of claim 14, wherein the first arm is slidable on and along the second arm to selectively adjust the relative position between the first and second arms.

17. The socket housing of claim 14, wherein the first housing segment comprises a third arm and the second housing segment comprises a fourth arm, the third and fourth arms being engaged to mechanically connect the first and second housing segments together, wherein a relative position between the third and fourth arms is selectively adjustable to selectively adjust the size of the recess.

18. The socket housing of claim 14, wherein the LED PCB comprises opposite first and second corners, the first housing segment being configured to be wrapped around the first corner in engagement therewith, the second housing segment being configured to be wrapped around the second corner in engagement therewith.

19. The socket housing of claim 14, wherein the first and second housing segments are at least one of hermaphroditic or substantially identical.

20. The socket housing of claim 14, wherein the socket assembly is configured to be mounted to a support structure, at least one of the first and second housing segments holding a spring that is configured to engage the LED PCB and apply a biasing force that biases the LED PCB in a direction toward the support structure.

* * * * *